United States Patent [19]

Elin

[11] Patent Number: 5,072,456

[45] Date of Patent: Dec. 17, 1991

[54] OUTERWEAR GARMENT FOR EMS PERSONNEL

[75] Inventor: Lewis R. Elin, South Bend, Ind.

[73] Assignee: Edmonton Manufacturing Company, Rochester, Ind.

[21] Appl. No.: 568,826

[22] Filed: Aug. 17, 1990

[51] Int. Cl.[5] ..... A41D 1/04

[52] U.S. Cl. ..... 2/94; 2/102; 2/247; 2/250; 2/253; 2/DIG. 6; 2/DIG. 7

[58] Field of Search ..... 2/94, 102, 247, 249, 2/250, DIG. 7, 251, 252, 253, 51, DIG. 6

[56] References Cited

U.S. PATENT DOCUMENTS

| | | | |
|---|---|---|---|
| 2,448,416 | 8/1948 | Carter | 2/247 |
| 4,637,075 | 1/1987 | Ingrisano et al. | 2/94 |
| 4,731,883 | 3/1988 | Foster | 2/247 |
| 4,969,214 | 11/1990 | Cohen | 2/94 |

*Primary Examiner*—Werner H. Schroeder
*Assistant Examiner*—Gloria Hale
*Attorney, Agent, or Firm*—Lockwood, Alex, Fitzgibbon & Cummings

[57] ABSTRACT

Outerwear garments for use by emergency medical services personnel particularly in cold weather months are provided with an exterior tool holster panel positioned on the exterior of the front of the garment. The tool holster panel includes a plurality of pockets each adapted to receive a piece of emergency medical equipment. Each pocket has a top opening which permits the item to be easily introduced and removed through the top opening in use. The tool holster panel is hingedly connected to a front panel of the garment so that its bottom edge is free to swing outwardly to thereby maintain the vertical alignment of the pockets when the wearer bends over a victim in use. The top hinged connection of the tool holster panel to a breast portion of the jacket prevents the contents of the pockets from being spilled in use and maintains the items within ready visual and manual access of the wearer. The usual bulkiness of winter weight coats or other garments do not interfere with these visual and manual access provided by the front mounted tool holster panel.

14 Claims, 3 Drawing Sheets

10
20
22
68
70
d
12
36
62
46
24
18
61
a
32
26
90
34
30
44
28
b
86
58
40
c
42
60
86
38
80
16
84
76
78
82
72
14
88
74
66
65

Fig.6
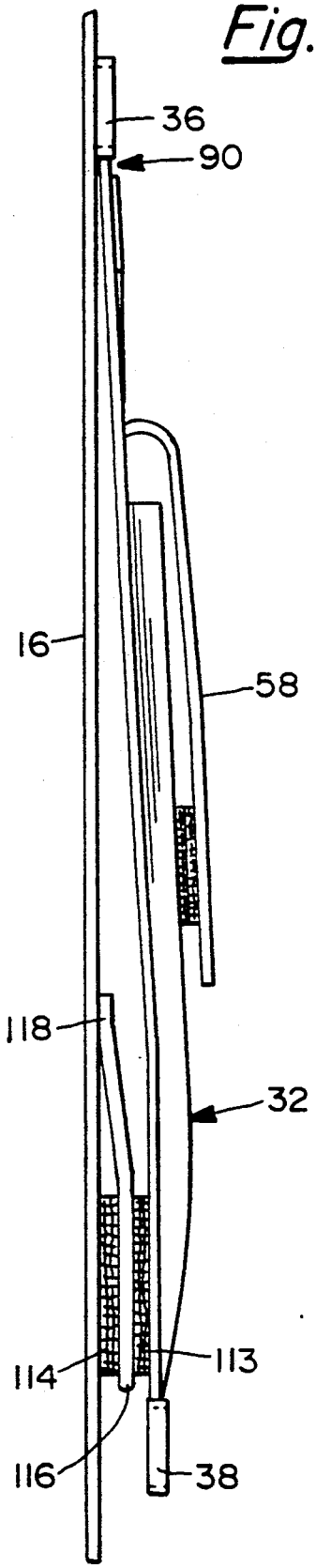
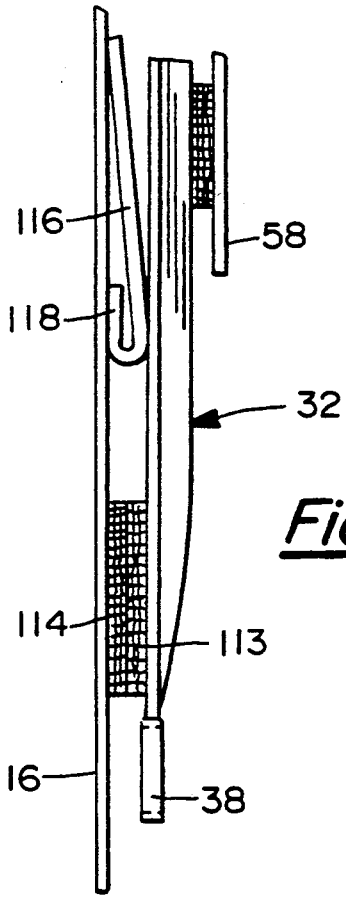
Fig.7

OUTERWEAR GARMENT FOR EMS PERSONNEL

The present invention relates to outerwear garments for use by emergency medical services personnel. More particularly, it relates to a new and improved outwear garment primarily for the upper body including a tool holster panel hingedly attached to a front panel of the garment and positioned so that each of the items in the tool holster are always within the direct view of the wearer and within easy reach, regardless of whether the wearer is in a standing or kneeling position with upper body vertically upright or forwardly bent over a victim.

Specialty equipment for use by emergency medical services personnel including emergency medical technicians, paramedics, police and fire/rescue squads and first aid assistants and the like have been developed in recent years. One major example of equipment of this type is a tool holster, usually comprising a leather panel. The tool holster is provided with belt loops for suspending it from the belt of the emergency medical personnel wearer. The holster includes a rectangular vertical backing sheet of leather provided with a number of forward facing pocket formations disposed at various locations on the front side thereof. Each of the pocket formations has a top opening which may optionally be provided with a fastenable covering flap.

Typically, the tool holster is suspended at the hip from the belt of the wearer and various specialty items used by emergency medical personnel such as scissors, tweezers, stethoscopes, blood pressure equipment, pen lights, gloves, airway tubes and the like, as well as, a variety of sterile gauze pads and bandages are stored or carried in the holster pockets. Each of the pocket formations may be individually configured or shaped to receive a particular standard piece of equipment, such as tongue depressors, for example. Accordingly, the tool holster may take on a standardized arrangement of items.

Generally, the tool holster panel has a sufficient length so that if it is worn in the front, the holster will interfere with walking and be uncomfortable in use. When the holster is moved to the side of the wearer's hip, the wearer generally must move either their upper body or their shoulders out of the way in order to view the contents of the tool holster from the top, which is a disadvantage.

The poor visibility of the belt worn tool holsters becomes more problematical in colder weather, such as during the fall, winter and spring months, when the emergency medical technician must also have on an outer coat or jacket to keep themselves warm. During these months, the tool holster belt arrangement is not satisfactory because the wearer's own coat must be moved out of the way to obtain a clear view of the tool holster and its contents. Moreover, outerwear garments are bulky so that even when the belt and holster are worn on the outside of the jacket or coat, the bulkiness of the jacket or coat interferes with the ability to see the contents of the holster or to slidably remove items from the pockets with unhampered ease.

Efforts to provide additional products for use by emergency medical personnel have included the design of specialty vests such as those described in U.S. Pat. No. 4,637,075 to Ingrisano et al. As described in this patent, an emergency medical vest is provided with a number of specialty pockets and strap means for holding various pieces of medical equipment. The vest is not specifically intended for cold weather use and accordingly, an outerwear coat or jacket must still be used under or over the vest. The particular arrangement of pockets and straps has been determined by the manufacturer and is dedicated in the device. Accordingly, the wearer does not have any freedom of choice or flexibility in moving the items where he or she would like them to be. Moreover, the configuration or organization of emergency medical items on the vest is non-standard and does not follow the presently accepted configuration of the tool holster. Moreover, most of the straps and pockets are provided in such a way that they are not immediately within the field of view of the person wearing the vest, often requiring the person to take the time to move his head or upper body to an erect position to provide a line of sight for the opening of the pocket or strap member. A distinct advantage of this vest is that it may be made to have reflective striping and can be provided in a number of unusually bright colors to distinguish the emergency medical personnel from police and other personnel that may be arriving at an emergency scene. In the case of a riot or other civil disturbance, the unique coloration for the emergency medical personnel can identify them quickly as a friend and permit them to get help to the injured, in a faster unobstructed manner.

It is also known that open topped pockets when placed on a shirt or a jacket or the like may disadvantageously permit things placed in the pocket to fall out due to gravity when the wearer bends over from the waist to a forward bended position. Numerous methods for preventing articles from falling out when the wearer bends over have included putting recloseable openings at the top of the pockets such as, button down flaps, snaps, zippers or hook and loop fastener closure means. Other methods have included permitting the bottom portion of the pocket to swing freely away from the front surface of the shirt or jacket garment. Examples of swing away type pockets are described in U.S. Pat. No. 683,029; U.S. Pat. No. 986,273; U.S. Pat. No. 2,011,010 and U.S. Pat. No. 4,667,347. The swing away pockets described in these patents are intended for various uses such as watch fobs or roofing nails or eye glasses. None of these aforementioned swing away pockets included a complex tool holster panel now considered standard issue for use by an emergency medical personnel.

Accordingly, in order to provide an improved outerwear garment for use by emergency medical personnel, it is an object of the present invention to provide an emergency medical tool holster panel on the outside of an upper body garment having pockets with top openings which remain within the field of view of the wearer at all times through a wide range of movements that the wearer may make in use.

It is another object of the present invention to provide a tool holster panel on the outside of an upper body garment for use by emergency medical personnel which places standard emergency medical equipment in a standardized configuration on the outside of an upper body garment in a location where each of the items may be readily and easily reached.

It is a further object of the present invention to provide a new and improved emergency medical outerwear garment having a front tool holster panel which prevents articles carried in the tool holster from falling out under conditions of use.

It is still another object of the present invention to provide a outerwear garment for emergency medical services personnel capable of keeping them warm in the colder Fall, Winter and Spring months in a non-bulky manner having a tool holster panel on the front outside portion of the garment which enables them to see and have access to their tools regardless of their own body position while treating an emergency victim.

SUMMARY OF THE INVENTION

In accordance with these and other objects, the present invention provides a new and improved outerwear garment for use by emergency medical services personnel. The outerwear garment of the invention comprises an upper body covering portion including a back panel, a front left panel and a right front panel. The back, left front and right front panels are adjoined along respective edges thereof to define an upper body covering portion having a top neck opening and left and right side arm holes. Typically, means for selectively joining and disjoining the left front panel and right front panel together are also provided.

In accordance with the present invention at least one tool holster panel is provided at breast level on a front panel of the garment. The tool holster panel has a forward facing surface, an opposed rear surface and a plurality of pocket means defined therein, each having entrance openings disposed at various locations on the front surface of the holster panel.

The holster panel is connected by means hingedly connecting the top edge of the holster panel to a front panel on the garment. The holster panel should be hingedly connected to a front panel and positioned so that the entrance openings of the pocket are visually observable by a wearer from the top, generally in a direction parallel to the length dimension of the holster panel, and generally without regard to the wearer's upper body position with respect to the ground.

The bottom edge of the holster panel, in accordance with this invention, is free to swing outwardly, away from its adjacent front panel, so that when the emergency medical technician bends forwardly, over from the waist, the items placed in the tool holster will not fall out but will remain within easy visual and gripping access by the medical technician. Preferably, the tool holster panel will be provided on the left front panel of the garment for ease of use by the majority of right handed persons. Also preferably, to maintain the tool holster panel in constant direct line of view of the wearer, the top edge portion of the holster is preferably positioned at the breast of a front panel at a point halfway to three quarters of the way up the length dimension of the front panel defined between the waist portion and top shoulder portion of the garment.

In accordance with the preferred embodiment, the tool holster panel is made from a woven fabric material which may be the same or similar to the fabric material making up the remainder of the shell of the garment. A waterproof or water repellant material frequently used for the outerwear garments, such as polyester or polyester cotton blend materials may be used. Preferably, the outerwear will comprise a hip length coat having a forward zipper closure connecting the left and right panels and a collar around the neck opening. Various other pockets and zippered vents may be provided throughout the jacket as will be more particularly described hereinafter.

Preferably, the color employed for the outerwear garment will be chosen to distinguish the emergency medical personnel from the police and other municipal respondents at an emergency medical scene. Royal blue, red and orange colorations are well suited for this purpose. Reflective striping may also be advantageously provided on the outerwear garment at appropriate locations to improve the night or bad weather visibility of the garment in use.

In accordance with the present invention, a comfortable, stylish and useful outerwear garment is provided to the emergency medical community which puts the tools of trade at their fingertips especially in a cold weather outerwear garment.

Other objects and advantages of the present invention will become apparent from the following Detailed Description of the Invention taken in conjunction with the Drawings, in which:

BRIEF DESCRIPTION OF THE DRAWINGS

FIG. 6 is an elevated cross-sectional view of the new and improved tool holster panel for use in the garments of the present invention illustrating a preferred means for selectively permitting the lower free end of the tool holster panel to be tacked down or to swing away in use and showing the tool holster panel in a swing away condition; and FIG. 7 is an elevated cross-sectional fragmentary view of the tool holster panel as shown in FIG. 6 with the selective flyaway feature shown in its locked, engaged or tacked down position to prevent the lower free end of the tool holster panel from swinging away from the front of the jacket in use.

DETAILED DESCRIPTION OF THE PREFERRED EMBODIMENT

Figure 1:
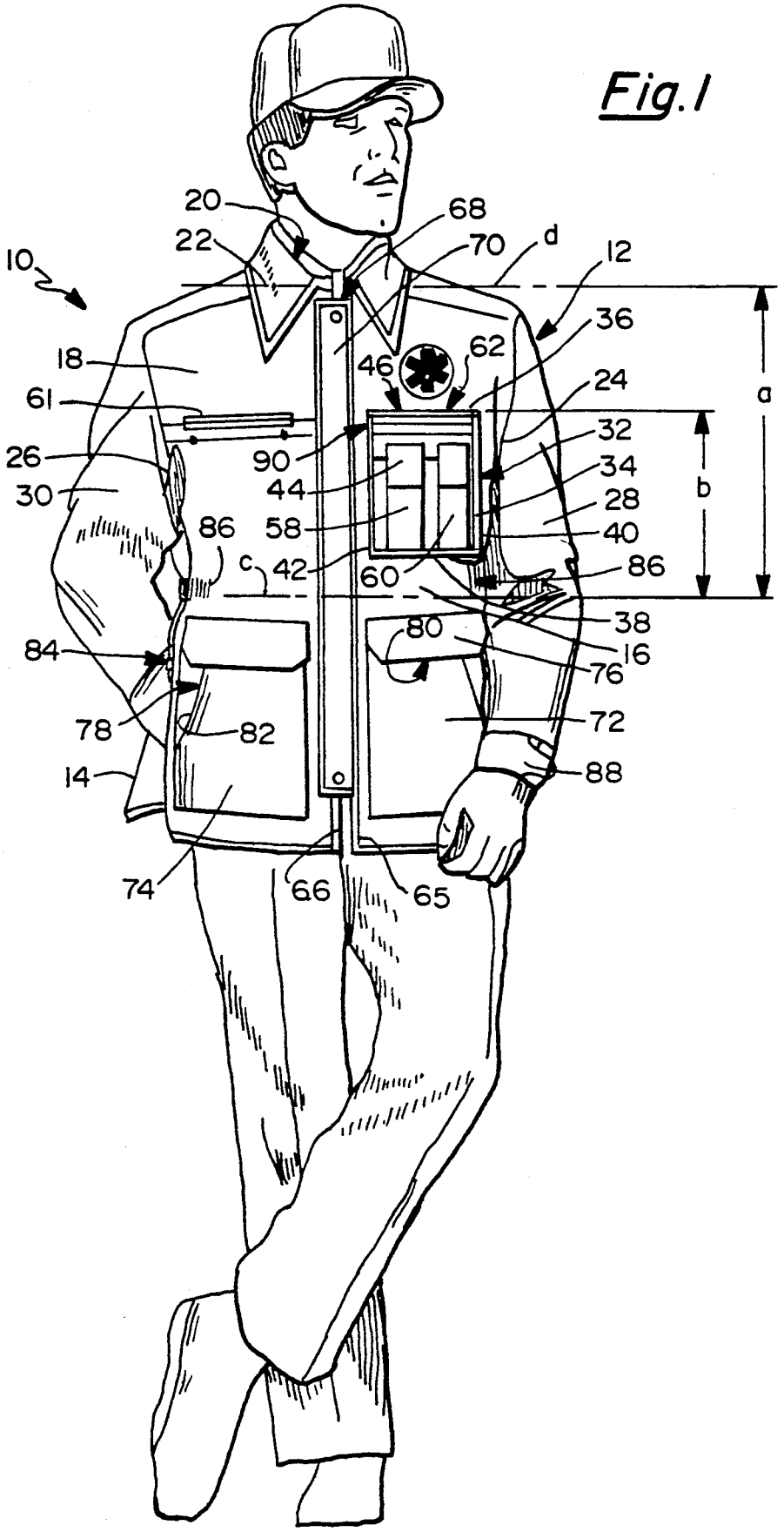
FIG. 1 is a perspective view of a new and improved emergency medical services hip length coat in accordance with a preferred embodiment of the present invention, having a tool holster panel affixed to the left front breast thereof.

Referring now to FIG. 1, a new and improved emergency medical services cold weather coat 10 in accordance with the present invention is shown. Coat 10 is of a hip length style and includes an upper body covering portion 12 including a rear or back panel 14, a left front panel 16 and a right front panel 18. The panels are sewn together and adjoined along appropriate seams to define a top neck opening 20 provided with a collar 22 and left and right side arm holes 24 and 26 from which left and right sleeves 28 and 30 extend, respectively. In accordance with the present invention a tool holster panel 32 is hingedly attached to the left front panel 16 for providing the emergency medical equipment within ready manual and visual access to the wearer.

In the preferred embodiment depicted in FIG. 1, the tool holster panel 32 comprises a generally rectangular woven fabric base panel 34 having a length dimension, 1, defined between a top edge 36 and a bottom edge 38 and a width dimension, w, defined between a left side edge 40 and a right side edge 42. The forward facing surface 44 of the tool holster panel 32 is provided with a plurality of pocket formations. Each pocket formation having a top opening defined along the front side surface 44 of the tool holster panel 32. In the preferred embodiment depicted in the drawings, the tool holster panel comprises an 8-in-1 pocketed holster panel including a large rear pocket 46 having a releasable closure 62, 64 of a hook and loop type disposed adjacent the pocket opening. The next layer on the front side 44 of holster panel 32 includes three open topped, vertical sleeve pockets indicated at 48, 50 and 52. The next layer includes two larger pockets indicated at 54 and 56. Finally, the top flap closure pleated pockets 58 and 60 extend forwardly from front face 44.

In the preferred embodiment depicted in FIG. 1, hip-length coat 10 includes a zippered upper right front stethoscope pocket 61. The inward free edges 65, 66 of the left and right front panels 16 and 18, respectively are provided with a two-way, self locking front zipper closure 68, a snap down front placket 70 covering for the zipper 68 is also provided. At the lower left and right front panels 16 and 18, two oversized, two-way divided pockets 72, 74 with top access pockets 76 and side access pockets 78 provided therein. The top access pockets 76 have a hook and loop fastened flap closure 80. The side access pockets 78 open from the side at 82 to keep the hands warm. Zippered side vents 84 at the left and right lower side of the garment 10 are provided to permit easy access to the wearer to pants pockets or other equipment suspended from a belt worn under coat 10. Elastic inserts 86 are provided on each side of the waist line to provide for a better gathered fit for increased styling and thermal warmth. Although elastic inserts sewn into the panels 14, 16 and 18 are shown, an external strap and buckle arrangement could be used to provide for cinchable waist adjustment.

Hip length coat 10 may be provided with a zip out thermal lining (not shown) made of thermally insulating materials, such as THINSULATE®. Other features for added warmth include hook and loop adjustable sleeve cuff fasteners 88 to provide for a snug wrist fit.

In accordance with the invention, the outer fabric from which the coat 10 and tool holster panel 32 are made preferably comprise a water repellant or water resistant fabric and any of the conventional woven shell fabrics might be used including fabrics made from polyester fibers, nylon fibers, polyolefin fibers such as polyethylene, polypropylene and polyvinyl chloride fibers, reinforced blends of these fibers and cotton blended materials of any of the foregoing fibers.

The method of assembling and sewing together the various panels comprising the coat 10 and the tool holster panel 32 are generally well known to those skilled in the garment arts. Various linings and/or filled panels may also be used including feather or down filled jacket panels.

In accordance with a preferred feature of the invention, the tool holster panel 32 is positioned on the left front panel 16 at a location which maintains the top openings of each of the pockets 46, 48, 50, 52, 54, 56, 58 and 60 within and at a glance position in the field of view of the wearer. As shown in FIG. 1, the elasticized waist inserts 86 define a waist line, c, to the garment. The distance between this waist line, c, and a mid point, d, along the shoulder line of the coat 10 is indicated as dimension, a, in FIG. 1 comprises an upper body length dimension to the garment. The top hinge or pivot line 90 at which the top edge portion 36 of the tool holster 32 is secured to the left front panel 16 is indicated as the length of dimension, b, in FIG. 1. To maintain ready visibility for articles placed in pockets 46, 48, 50, 52, 54, 56, 58 and 60 the distance, b, measured upwardly from the waist should be between one half and three quarters of dimension a, as measured in the upwards direction. If dimension, b, is made significantly larger than one half to three quarters of dimension a, then the top edge 36 of the tool holster panel 32 is too high on the chest to be readily viewed by the wearer. If the top edge 36 of the tool holster panel 32 is placed at a position significantly below $\frac{1}{2}$a, the curvature of the chest would tend to obscure the wearer's ability to readily observe the top openings of the pockets 46, 48, 50, 52, 54, 56, 58 and 60. Especially preferably, dimension b will be between about $\frac{1}{2}$a and $\frac{2}{3}$a.

Figure 2:
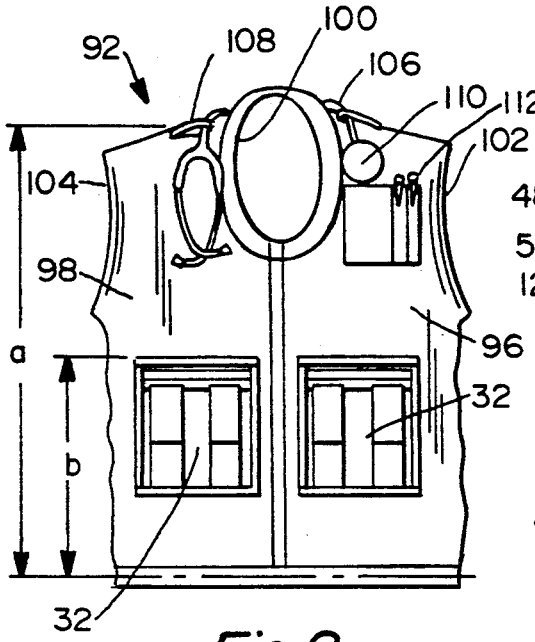
FIG. 2 is an elevated front view of an alternate garment embodiment in accordance with the present invention comprising an emergency medical vest including with left and right front tool holster panels mounted and provided in accordance with the present invention.
Figure 3:
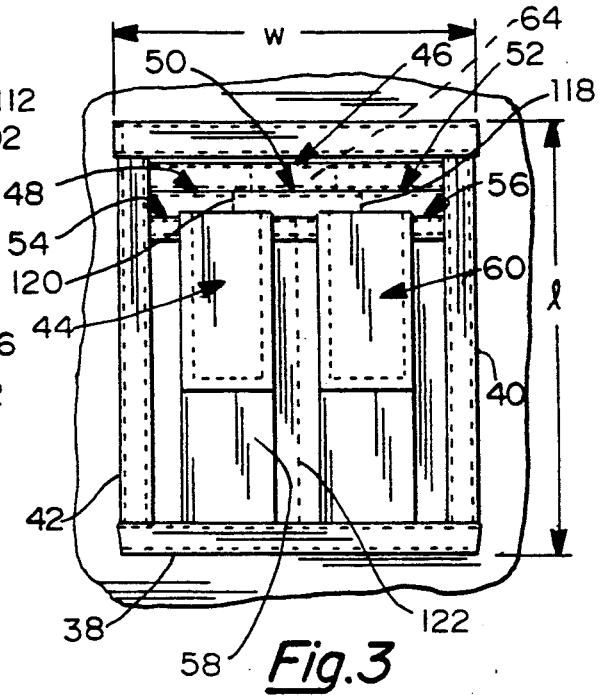
FIG. 3 is a front elevation view of the new and improved tool holster panel for use in the present invention.
Figure 4:
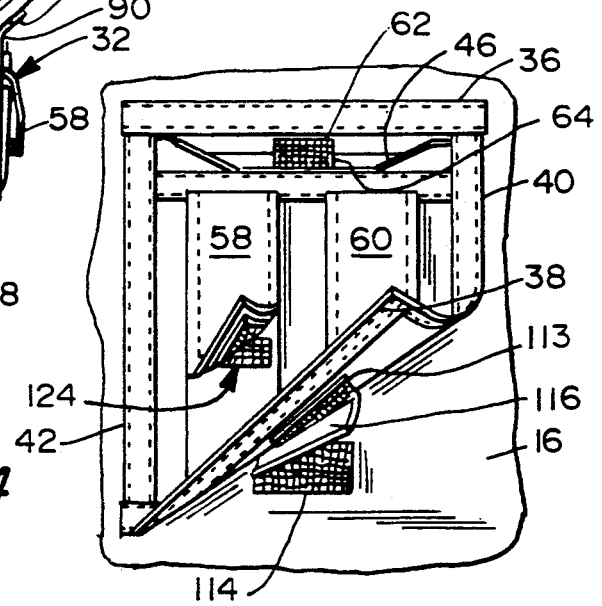
FIG. 4 is a front elevation view of the new and improved tool holster panel for use in the garments of the present invention with portions of the tool holster panel bent back to illustrate the selective fasteners for use therewith.

Referring now to FIG. 2, an alternate outerwear garment embodiment of the present invention comprising an emergency medical services vest 92 is shown. Vest 92 includes an upper body covering portion also defined by a back panel 94, a left front panel 96 and a right front panel 98 with the top neck opening 100 and side arm holes 102, 104. As depicted in FIG. 2, left front panel 96 and right front panel 98 are each provided with a tool holster panel 32 as shown. A pair of hook and loop fastenable straps 106, 108 are provided along the shoulder line so that the stethoscope 110 may be draped around the neck and secured to the vest 92 as shown in FIG. 2. An upper auxiliary pocket 112 is provided on the front of the shoulder of the left panel 96 to receive pens, pen lights, paper and the like. The tool holster panels 32 are substantially the same as those shown in FIG. 1. As in FIG. 1, the top hinged connection 90 at the top edges 36 of each of the tool holster panels 32 is shown on vest 92 are positioned at a height dimension b which is selected to be between one half dimension a and $\frac{3}{4}$ a and especially preferably b is between $\frac{1}{2}$a to $\frac{2}{3}$a, as shown Referring now to FIGS. 3 and 4, the detailed construction of the woven fabric tool holster panels 32 for use in the emergency medical outerwear garments in accordance with the present invention are shown. As shown in FIG. 3, the tool holster panel 32 includes an elongate rectangular base panel layer 34 having a front surface on which a plurality of other woven fabric layers may be overlayed and stitched to define multiple pocket means 46, 48, 50, 52, 54, 56, 58 and 60. Edge portions along the top 36, bottom 38 and left and right sides 40 and 42 are stitched or sewn to secure the tool holster panel 3 together.

In accordance with the preferred embodiment, the tool holster panel 32 comprises an 8-in-1 pocketed panel including an enlarged rear panel pocket 46 having cooperative hook and loop fasteners 64 disposed in the central portion of its recloseable opening. Disposed on a front surface of that divider is an overlayed top sheet sewn at the left and right end edges 40 and 42 and the bottom edge 38 and along two intermediate stitched vertical seams 118, 120 to define three narrow elongate open topped pockets 48, 50 and 52. A second intermediate layer sewn at the edges and bottom and at one centrally located vertical seam 122 defines two more larger open topped pockets 54 and 56. A pair of accordion pleated front pockets 58 and 60, are provided. Front pockets 58 and 60 each having a top flap covered opening provided with hook and loop fastener tabs indicated at 124 in FIG. 4.

The method for making a tool holster panel 32 of this type will be readily apparent to those skilled in this art. Primarily stitching will be used to join the various layers defining the pocket means to the elongate rectangular rear layer or base panel 34. Depending on the materials employed, adhesive bonding or heat welding of the layers of materials may also be performed to provide a satisfactory tool holster panel 32.

In accordance with the invention, the tool holster panel 32 is hingedly connected along its top edge portion 32 to its adjacent front panel 16 by either directly stitching it to the front panel to define a pivot or hinge line 90 or a separate U-shaped fabric hinge panel (not shown) may be provided. In accordance with this alternate arrangement, the top edge 36 of the tool holster rear panel 34 is first stitched to the inverted U-shaped hinge panel and an opposed side of the U-shaped hinge panel is secured to the front panel 16 of the garment.

Figure 5:
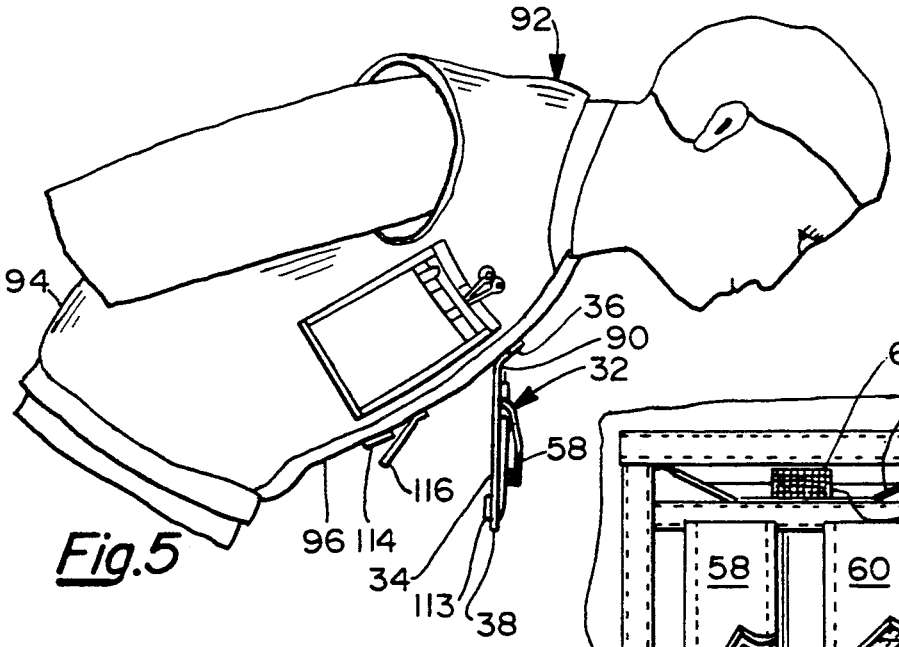
FIG. 5 is a perspective view of the new and improved EMS vest similar to FIG. 2 illustrating the fly away feature of the tool holster panel in accordance with the present invention.

In accordance with the fly away feature of the tool holster panel 32 for use in the outer wear garments of the present invention, the bottom edge portion 38 of the tool holster panel 32 will be free to swing away from the front panel 16 to which is attached in use, to prevent the contents of the tool holster pockets 46, 48, 50, 52, 54, 56, 58 and 60 from falling out due to gravity when the wearer bends over from the waist as shown in FIG. 5. The swing out feature keeps the items placed in the tool holster panel 32 in a substantially vertically upright orientation and within an immediate visual field of the wearer as shown in FIG. 5. In accordance with the preferred embodiment, the lower free end 38 of the tool holster panel 32 may optionally be provided with means to selectively secure it to the front panel 16 to prevent the swing away feature from being operative.

Referring now to FIGS. 4–7, the means for selectively preventing the swing away feature includes a hook and loop fastener tab 113 being located on the rearward facing lower edge portion of the tool holster panel 32 which is positioned to engage a complimentary hook and loop fastener 114 provided on the adjacent front panel 16 surface. The selectively feature is provided in a hinged flap 116 of fabric sewn to the front panel 16 and disposed at a location such that it may be moved in a downward, swing away operative position, wherein the fabric tab 116 overlies the hook and loop fastener 114 provided on the front panel 16 to prevent cooperative engagement with the aligned hook and loop fastener tab 113 provided on the bottom edge 38 portion of the tool holster panel 32 as shown in FIG. 6. In this position of the fabric tab 116, the tool holster panel 32 will be free to swing outwardly to maintain the visual access and vertical orientation of the pockets of the tool holster panel, regardless of the upper body position of the medical personnel wearing the garment.

In a second alternate position of the selectable swing away feature shown in FIG. 7, the fabric tab 116 is pivoted or swung upwardly away from the hook and loop fastener tab 114. In this raised condition as shown in FIG. 7, the aligned hook and loop fastener tabs 113, 114 are free to be cooperatively engaged with one another to effectively prevent the bottom edge portion 38 of the tool holster panel 32 from swinging outwardly when the upper body position of the wearer changes.

Although the present invention has been defined with reference to certain preferred embodiments, modifications or changes may be made therein by those skilled in this art. For example, instead of providing a hip length coat, a waist length coat may be provided. Instead of providing a vest, a full length, one piece jump suit garment might also be used. Instead of making the garments from a heavy winter weight material to provide warmth in winter months, a lighter weight material might be used without a lining or the like so that the garment might be used all year long. Although many of the pockets and fastening means described for use herein comprise hook and loop fastener means, other quick release fasteners such as snaps or zippers may also be substituted. Hook and loop fasteners are preferred because of the speed with which they may be fastened or released. Instead of a central front zipper, snaps or buttons may be substituted for securing the garment to the body of the wearer. All such obvious modifications may be made herein by those skilled in this art without departing from the scope and spirit of the present invention as defined by the appended claims.

I claim:

1. An outerwear garment for use by emergency medical services personnel comprising:

an upper body covering portion including a back panel, a left front panel and a right front panel, a top neck opening and left and right side arm hole openings, means for selectively joining and disjoining the left front panel and the right front panel together and at least one tool holster panel, said tool holster panel having a length dimension defined between a top edge and an opposed bottom edge and a width dimension defined between left and right spaced and opposed side edges, said holster panel further having a front surface and a rear surface and having a plurality of pocket means defined therein, each of said pocket means having an entrance opening disposed in said front surface, said garment further including means hingedly connecting the top edge of a said holster panel to a said front panel so that said entrance openings are visually observable by a wearer from the top in a direction parallel to the length dimension of the holster panel, the bottom edge of the holster panel being generally free to swing away from the adjacent front panel so that if the wearer bends over forwardly from the waist, items placed in the pocket means will not fall out and will remain visible and within easy manual reach and access of the wearer.

2. A garment as defined in claim 1, wherein said garment is a full length coat.

3. A garment as defined in claim 1, wherein said garment is a hip length coat.

4. A garment as in claim 1, wherein said garment is a waist length jacket.

5. A garment as in claim 1, wherein said garment is a waist length vest.

6. A garment as in claim 1, wherein said garment is a one piece coverall jumpsuit.

7. A garment as in claim 1, wherein said tool holster panel comprises woven fabric.

8. A garment as defined in claim 1, comprising water repellant fabric material.

9. A garment as defined in claim 1, comprising a woven fabric tool holster panel wherein said woven fabric is selected from woven fabrics of polyolefin fibers, polyester fibers, nylon fibers, cotton fibers and unreinforced and reinforced blends of the foregoing fibers.

10. A garment as defined in claim 1, further comprising means for selectively, releasably attaching a lower portion of the tool holster panel adjacent its bottom edge to the adjacent front panel to optionally prevent the holster panel from freely swinging outwardly in use.

11. A garment as in claim 3, further comprising a collar, left and right sleeves and having a plurality of other pockets provided therein.

12. A garment as defined in claim 1, further including a top shoulder portion adjacent the neck opening and a defined waist portion, said garment having a height dimension extending normally from the shoulder portion to the waist portion along said front panel, the top edge of said tool holster panel being hingedly attached to the front panel at a location corresponding to between about one half and about three quarters of the height dimension measured upwardly from the defined waist portion along said front panel.

13. A garment as defined in claim 10, wherein said means for selectively releasing includes first releasable fastening means on the rear side of the bottom of the tool holster panel adjacent the bottom edge thereof and a cooperating second releasable fastening means in an aligned position on the front of the front panel.

14. A garment as defined in claim 13, further including cover flap means positionable between the first and second releasable fastening means to maintain the bottom edge of the tool holster panel in a freely swingable condition with respect to the front panel of the garment for use.

* * * * *